United States Patent [19]

McGee et al.

[11] 4,116,277

[45] Sep. 26, 1978

[54] FULL FLOW TUBING PLUG WITH LOCKED ANCHOR AND METHOD

[75] Inventors: John K. McGee; Charles D. Bridges, both of Houston, Tex.

[73] Assignee: Gray Tool Company, Houston, Tex.

[21] Appl. No.: 786,934

[22] Filed: Apr. 12, 1977

[51] Int. Cl.[2] ..... E21B 23/02

[52] U.S. Cl. ..... 166/315; 166/123; 166/182; 166/188

[58] Field of Search ..... 166/129, 134, 139, 315, 166/182, 123–125, 188

[56] References Cited

U.S. PATENT DOCUMENTS

| | | | |
|---|---|---|---|
| 3,019,842 | 2/1962 | Nutter | 166/134 |
| 3,289,766 | 12/1966 | Bigelow | 166/139 |
| 3,294,172 | 12/1966 | Brown | 166/139 |
| 4,071,084 | 1/1978 | Brown et al. | 166/129 |

*Primary Examiner*—Ernest R. Purser
*Attorney, Agent, or Firm*—Cushman, Darby & Cushman

[57] ABSTRACT

A down-hole assembly is provided including particular structure for holding the assembly in place in a tubing hanger or the like. Camming wedges are associated with a cylindrical cage, the camming wedges being movable radially with respect to the cage to hold the cage in place in a tubing hanger. A tubular sleeve having camming portions thereon is concentric with the cage and effects radial movement of the camming wedges. A seal is also provided, and may include a structure that is radially movable from the cage into contact with the tubing hanger in response to axial movement of the sleeve. The sleeve may be locked in place to hold the camming wedges in holding engagement. Locking of the sleeve in place is effected by rotative movement of a locking nut. The sleeve may be released from its locked position either by reverse rotation of the locking nut or by release of an emergency retaining nut. A back pressure valve is mounted at the bottom of the cage, attached to a tubular mandrel extending concentrically with the sleeve and cage.

26 Claims, 4 Drawing Figures

FULL FLOW TUBING PLUG WITH LOCKED ANCHOR AND METHOD

BACKGROUND AND SUMMARY OF THE INVENTION

The invention relates to a down-hole assembly, such as a tubing plug, and to the particular structure for holding the assembly in place in a tubing hanger or the like and a method associated therewith. While the present invention is desirably utilized with a tubing plug, the principles thereof may also be utilized with a packer, plug, retainer, or other similar down-hole structures. The term "tubing hanger or the like" means tubing hangers, well casings, etc.

According to the structure of the present invention, several simple components are provided which effect the holding of the plug or the like in a down-hole position and allow ready removal thereof. The down-hole assembly includes a cylindrical cage, a tubular mandrel disposed concentrically within the cage, a spline connection between the cage and the mandrel being provided, a sleeve camming means concentric with the cage and mandrel and disposed therebetween, and holding means radially movable with respect to the cage for holding the down-hole assembly in place. Locking means are provided for locking the camming means into place, and means are provided operatively connected to the camming and locking means for receiving an actuator member (i.e. polish rod) for actuation of the camming and locking means. Upon axial movement of the sleeve, camming portions thereof cam the holding means outward into engagement with the tubing hanger and may simultaneously compress sealing means so that they move radially into sealing engagement between the cage and the tubing hanger. The sleeve is then locked in place by the locking means, a rotative mode of operation of the locking means resulting in the locking of the sleeve in position. When release of the holding means is desired, release may be effected by reverse rotation of the locking means, or by removal of a retaining nut acting between the locking nut and the mandrel. Quick release of the holding means may thus be effected.

A locating ring may also be provided for facilitating holding of the assembly in proper position within a tubing hanger upon linear axial movement of a camming means so that the whole structure is not displaced during camming of the holding means into holding position. The friction between the tubing hanger, holding means, camming means, and cage means upon axial movement of the camming means may be minimized by the provision of spring means acting between the cage means and the locating ring.

When a tubing plug is provided as a down-hole member, the plug may include a tubular valve housing attached to the mandrel at the lower end thereof, a check valve being disposed within the valve housing and biased into sealing engagement therewith. The check valve may include a spring biased dart shaped valve member having a spring biased pilot valve disposed therein.

According to the method of the present invention, a down-hole member is located in place by lowering the down-hole member into a tubing hanger with a running tool to the desired down-hole position. A structure for holding the down-hole member in place in the tubing hanger is then actuated by actuation of the running tool in a first mode, and the structure for holding the down-hole member in place is locked in the holding position by actuation of the running tool in a second mode different from the first mode. The first mode is preferably a linear axial movement, whereas the second mode is a rotative movement. Removal of the running tool from the well casing may be effected only after locking of the holding structure for the down-hole member in place.

Also according to the method of the present invention, the down-hole member may be removed in one of two ways. The first way comprises the steps of actuation of the running tool in said second mode to release locking of the holding structure, actuating the running tool in the first mode to deactivate the holding structure, and removing the down-hole member from the tubing hanger by raising the running tool, detachment of the running tool and down-hole member being prevented. According to the second manner of removal of the down-hole member, another tool is actuated in a third mode to simultaneously release locking of the holding structure and release holding of the holding structure, and subsequently the down-hole member is removed with the running tool. The third mode of operation can include unscrewing a locking screw holding a retaining nut in engagement with the mandrel and the locknut.

It will be seen that according to the present invention a structure has been provided which provides simple yet secure locking of a down-hole member in place in a tubing hanger. Removal of the running tool for locking the member in place is not possible until the lock has been completely effected. Both the holding and locking of the down-hole member are accomplished by movement of the same running tool. In an emergency situation, the down-hole member can be released by removal of a retaining nut rather than by movement of a locking member. Simultaneous actuation of the holding member and sealing members can be effected, and the whole structure is held in place during the movement of the holding members into place by a locating ring. It will be seen that the structure according to the present invention is simple yet effective for accomplishing its desired function.

It will additionally be seen that also according to the present invention a method has been provided for locking a down-hole member in place and for removing the down-hole member, the locking of the member in place and the removal of the member both being accomplished by simple actuation of a running tool, and the locking taking place in a failsafe manner. Emergency release of the down-hole member is also provided for.

It is the primary object of the present invention to provide a simple method and apparatus for effectively securing a down-hole member in place in a well casing. This and other objects of the invention will become clear from an inspection of the detailed description of the invention and from the appended claims.

DETAILED DESCRIPTION OF THE INVENTION

Figure 1:
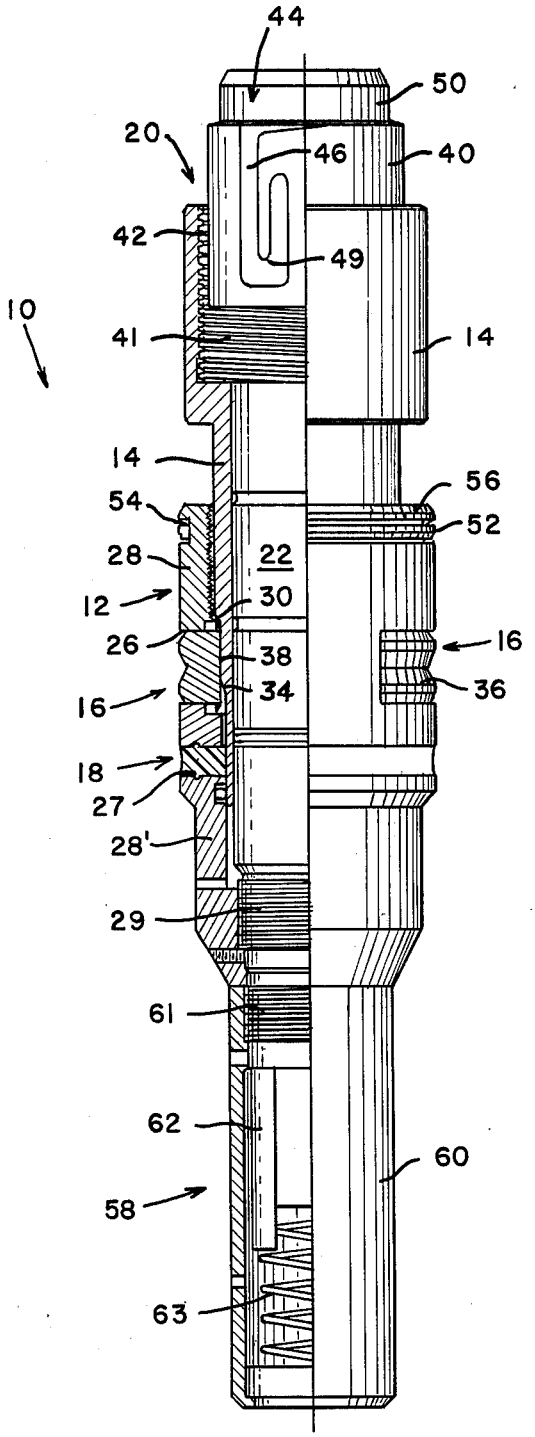
FIG. 1 is a side view, partly in section and partly in elevation, showing an exemplary down-hole assembly according to the present invention.

The down-hole assembly 10 according to the present invention has as the main components thereof a cage 12 with a sleeve 14 which functions as a camming means concentric therewith, holding means 16 that are radially movable with respect to the cage 12 to hold the cage 12 in place in a tubing hanger or the like, sealing means 18 for effecting the seal between the cage 12 and the tubing hanger, and locking means 20 for locking the holding means in their holding position. The cage 12 includes a generally tubular member having opening 26 formed therein for receipt of the holding means for radial movement thereof, and openings 27 are provided for the sealing means 18. The cage 12 may comprise upper and lower portions 28, 28' respectively with the sealing means 18 disposed therebetween. In such a case especially it is desired to have an interior tubular mandrel 22 to which the lower cage portion 28' is connected (i.e. by threads 29) and spline means 24 are provided for threadably connecting the mandrel 22 to the cage 12 while allowing sliding movement of the sleeve 14 with respect to the cage 12 and mandrel 22.

Figure 2:
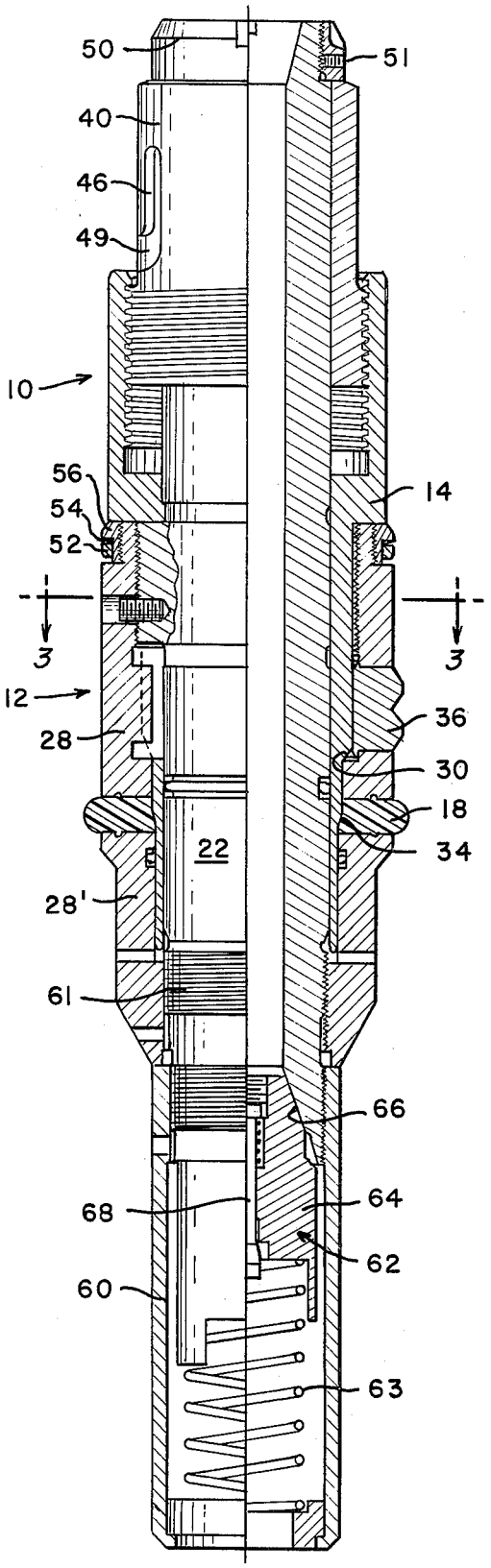
FIG. 2 is a view similar to FIG. 1 only showing the assembly in locked holding position, again with some of the elements in section and others in elevation.
Figure 3:
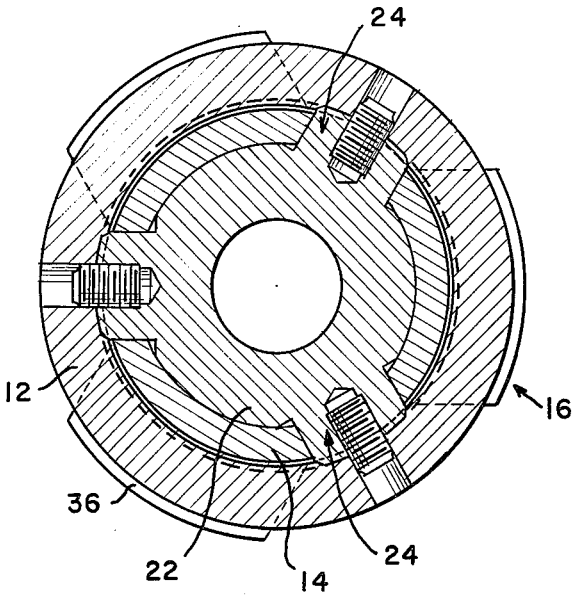
FIG. 3 is an end sectional view taken along lines 3—3 of FIG. 2.

The sleeve 14 includes a tubular member that is disposed between the mandrel 22 and cage 12 and has camming portions 30 formed thereon. The sleeve 14 has a plurality of openings 32 formed therein for receipt of the spline means 24, the sleeve 14 being linearly movable with respect to the mandrel 22 and cage 12 but not being rotatable with respect thereto. Upon linear movement of the sleeve 14 from the position shown in FIG. 1 to the position shown in FIG. 2, the camming portions 30 engage the holding means 16 and radially move them so that they extend outwardly past the periphery of the cage 12 and hold the cage 12 in place in the tubing hanger. Preferably second camming portion 34 are also provided on the sleeve 14 for radially moving the sealing means 18 so that a seal is provided for isolating the annulus between the cage 12 and the tubing hanger from well pressure. Thus, in a single stroke of the sleeve 14 the holding and sealing are effected.

The holding means 16 according to the present invention may comprise a plurality of lockdown wedges 36 movable in the openings 26 provided in the cage 12. Other configurations may also be provided aside from those illustrated in the drawings as long as an interior cam following portion 38 is provided for cooperation with the camming portions 30, and the members 36 are radially movable with respect to the cage 12. While the sealing means desirably are radially moved by the second camming means 34, if desired a separate actuation may be provided for the sealing means 18 such as a fluid pressure source that is actuated from the surface or another location remote to the well casing. The camming means 34 also could effect actuation of a fluid pressure means for pressurizing the sealing means 18 and effecting the seal with the well casing and the cage 12.

Figure 4:
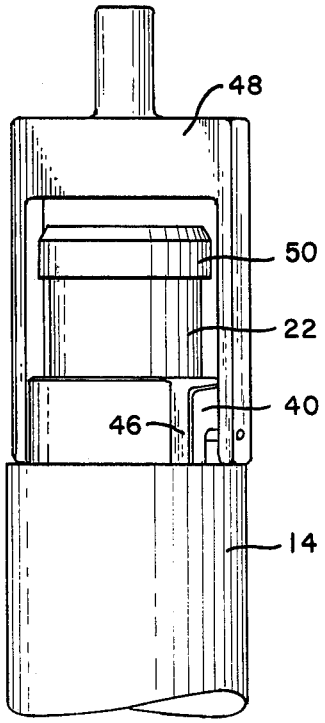
FIG. 4 is perspective view showing the utilization of a simulated cutaway running tool for manipulation of the assembly according to the invention.

While the locking means 20 may take a variety of forms so long as it functions to hold the holding members in place in their hanger-engaging position, preferably the locking means 20 comprises a locknut 40 which is in threaded engagement by threads 41 with the interior threaded portion 42 of the sleeve 14. The nut 40 preferably also includes means 44 operatively associated therewith for receiving an actuating tool for actuation of the camming means 14 and locking means 20. The means 44 preferably comprises a J-shaped slot or other surface manifestation 46 in the surface of the nut 40. The slot 46 receives a running tool 48 such as shown in FIG. 4. By axially (with respect to the cage 12) moving the running tool 48, the sleeve 14 is directly engaged by the running tool 48 and indirectly through the threaded connection 41, 42 to effect linear movement thereof. Upon rotative movement of the tool 48, the nut 40 is rotated with respect to the sleeve 14 (the sleeve 14 being held stationery with respect to the cage 12 and mandrel 22 by the spline means 24 during such rotation) thereby either threading or unthreading the coupling 41, 42. It is noted that the J-slot 46 is so dimensioned that the tool 48 cannot be removed from the slot 46, the upper portion of the sleeve 14 blocking movement of the tool 48 to the bottom loop 49 of the slot 46, unless the loop 49 is above the top of the sleeve 14; when the loop 49 is above the top of the sleeve 14, the nut 40 will be engaging a retaining nut 50 while the sleeve 14 is locked in its cam-actuating position (see FIG. 2). It will be seen that the holding means 16 will be actuated by a straight-push motion of the running tool 48, a first mode actuation thereof, and the locking will be effected by rotation of the running tool 48, a second mode of actuation thereof. It is noted that the running tool 48 may comprise a manually or hydraulically operated structure, or other common running tool as is known in the art.

Under emergency conditions, release of the holding means 16 may be provided by actuation of a separate tool in a third mode different from said first and second modes. Such emergency release may be effected by releasing screw 51 holding the retaining nut 50 onto the mandrel 22 with a screwdriver, or by other means for remotely disengaging the nut 50 from the mandrel 22. When the nut 50 is released, the locking member 40 no longer has a stationery surface to abut and therefore the nut 40 and sleeve 14 connected thereto by the threads 41, 42 can be pulled upwardly by the running tool 48.

In order to facilitate holding of the cage 12 in proper position within a tubing hanger during the axial movement of sleeve 14 to cam the holding means 16 into engagement with the tubing hanger, a separate structure may be provided such as a floating locating ring 52. The locating ring 52 has a peripheral portion thereof that extends slightly outwardly from the cage 12 to engage a shoulder provided in the tubing hanger or the like, enough holding force being provided thereby to provide some support for the cage 12 to steady it in the tubing hanger during linear movement of the sleeve 14. Means may also be provided for minimizing the friction between the tubing hanger, holding means, camming means and cage upon a linear axial movement of the camming means, such friction minimizing means comprising spring means 54 acting between the locating ring 52 and the cage 12, a locating ring retainer 56 being provided in threaded engagement with cage 12 for providing a surface above the ring 52 on which the spring 54 may act.

The down-hole member supported by the holding means 16 may be any one of a wide variety of down-hole elements, such as a packer, retainer, or the like. Preferably, however, the down-hole member is a tubing plug 58, which may include a valve housing 60 operatively connected — as by threads 61 — to the mandrel 22. The housing 60 is tubular being concentric with the opening in the tubular mandrel 22, and a check valve 62 is disposed therein biased into sealing engagement with the mandrel 22 by a spring 63 or the like. The plug 58 may be a single assembly for all sizes of assemblies 10 which allows for maximal bore through the valve. The check valve 62 preferably comprises a dart shaped valve member 64 tapered for sealing engagement with a tapered formation 66 formed on the bottom of the mandrel 22. If desired, the mandrel 22 can be formed so that it has another tapered portion 66 at the other end thereof for cooperation with another check valve should it be desired to make the assembly 10 bi-directional. A spring biased pilot valve also may be provided within the dart shaped member 64. The running tool 48 may incorporate a stinger which either biases the dart shaped member 64 or the pilot valve 68 off of its seat so that the pressure is always equalized across the plug when the running tool is engaged with the plug. Once the running tool 48 is removed the valve members 64 and 68 can then function in their normal checking capacity.

According to the method of the present invention a down-hole member 10 is locked in place in a well casing by:

(a) lowering the down-hole member 10 into the well casing with a running tool 48 to a desired down-hole position;

(b) activating a structure (16) for holding the down-hole member 10 in place by actuation of the running tool 48 in a first mode (i.e. axial movement thereof);

(c) locking the structure (16) for holding the down-hole member in place in its holding position by actuation of the running tool 48 in a second mode (i.e. rotation) different from the first mode; and (d) effecting removal of the running tool 48 from the well casing only after the locking (by nut 20) of the holding structure (16) for the down-hole member 10 is effected.

The activation, of course, takes place by the radial movement of the means 16 in response to the linear movement of the camming portions 30 of sleeve 14, and locking takes place by the rotative movement of the members 40 and 14 resulting in linear displacement of the members 40 and 14 as a result of the threaded connection 41, 42 therebetween. The member 10 is in its locked position in FIG. 2.

The method according to the present invention also includes the removal of the down-hole member by practicing the further steps of actuation of the running tool 48 in a second mode to release locking of the holding structure (16) in its holding position, actuating the running tool 48 in the first mode to deactivate the holding structure (16) for the down-hole member so that it no longer holds the member in its desired position, and removing the down-hole member 10 from the well casing by raising the running tool 48 (and along with it the locknut 40, sleeve 14, cage 12, mandrel 22, and tubing plug 58), detachment of the running tool 48 and the down-hole member 10 being prevented (by the provision of the J-shaped slot 46 and its cooperation with the sleeve 14). Alternatively, should emergency removal of the down-hole member be necessary, the steps that are further practiced are actuation of a separate tool in a third mode (i.e. unscrewing of the screw 51 holding retaining nut 50 on mandrel 22) to simultaneously release locking of the holding structure (16) in holding position and release holding of the holding structure in its holding position, and subsequently removing the down-hole member 10 with the running tool 48.

It will be seen that according to the present invention a down-hole assembly and method of installation and removal have been provided which have numerous advantages. For instance, the assembly according to the present invention may be set manually or with a plugging tool and may be set or released in one stroke of the plugging tool. The back pressure valve provides maximum circulation compatible with the tubing size, and the assembly is designed for use in extreme service. The assembly can accommodate full design pressure from both above and below, and uses a compression type seal, and the running tool assures that the pressure is equalized until the plug is properly set and locked in place. The floating locating ring accommodates physical damage to the tubing hanger, the running tool cannot be disconnected until the assembly is properly locked in position, and major parts of the assembly are spline locked together so that they cannot get out of adjustment. According to the present invention a simple yet effective structure is provided for holding a down-hole member in place within a tubing hanger or the like, and the method of insertion and removal of the down-hole member is similarly simple.

While the invention has herein been shown and described in which is presently considered to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A down-hole assembly comprising:

(a) a generally cylindrical cage portion having a linear axis and adapted to be lowered into and then stationarily disposed within a tubing hanger or the like, (b) means defining a fluid conducting bore concentric with said cage portion, (c) means for holding said cage portion in place within a tubing hanger or the like, said means including holding members that are radially movable with respect to said cage portion to protrude past the radial extent of said cage portion and engage a tubing hanger or the like, (d) means for camming said holding members so that they move radially from a first position wherein they do not protrude past the radial extent of said cage portion to a second position wherein they do protrude past the radial extent of said cage portion and engage a tubing hanger or the like, (e) means for preventing relative rotational movement between said camming means and said holding means, and for preventing relative movement between said cage portion and said means defining a fluid conducting bore, (f) means for providing a seal isolating the annulus between said cage portion and a tubing hanger or the like from well pressure, said seal provided generally coincident with radial movement of said holding members into said second position, (g) means for locking said camming means in place so that said holding members are retained in said second position until release of said locking means, and (h) means operatively associated with said camming and locking means for receiving actuating means for actuation of said camming and locking means.

2. An assembly as recited in claim 1 wherein said camming means comprises linearly axially movable means.

3. An assembly as recited in claim 2 wherein said means for providing a seal coincident with radial movement of said holding members comprises sealing means responsive to linear axial movement of said camming means so that said seal radially expands into engagement with the tubing hanger or the like without axial compression thereof.

4. An assembly as recited in claim 2 wherein said means for locking said camming means comprises a locking member rotatable with respect to said camming means and in threaded engagement therewith.

5. An assembly as recited in claim 4 wherein said means for receiving actuating means comprises surface means on said locking member for receipt of a running tool for effecting relative rotational movement between said camming means and said locking member.

6. An assembly as recited in claim 4 further comprising means separate from said locking member for releasing locking of said holding members without rotative movement of said locking member.

7. An assembly as recited in claim 2 further comprising means for allowing radially movement of said holding means and for preventing pivotal movement thereof.

8. As assembly as recited in claim 1 further comprising a generally tubular mandrel disposed concentric with said cage means and radially inwardly thereof and wherein said camming means and locking means are also generally cylindrical and are disposed concentric with said cage means and radially between said cage means and said mandrel.

9. An assembly as recited in claim 8 further comprising a tubular valve housing attached to said mandrel at one end thereof, and a check valve disposed within said valve housing and biased into sealing engagement therewith, whereby said assembly functions as a tubing plug.

10. An assembly as recited in claim 9 wherein said check valve includes a spring-biased dart-shaped valve member having a spring-biased pilot valve disposed therein.

11. An assembly as recited in claim 9 further comprising a tubular valve housing attached to said mandrel at the other end thereof so that said assembly is bi-directional.

12. An assembly as recited in claim 8 further comprising spline means between said cage means, camming means and mandrel.

13. A down-hole assembly comprising (a) a generally tubular fluid-conducting mandrel, having a linear axis, (b) a sleeve surrounding said mandrel and concentric therewith, and spline-connected to said mandrel so that relative rotational movement between said sleeve and mandrel is prevented, but relative axial displacement therebetween is possible, (c) a locking nut concentric with said sleeve and said mandrel and in threaded operative engagement with said sleeve, for maintaining said sleeve and mandrel in a given relative axial position, (d) a generally tubular housing concentric with and surrounding said sleeve, and stationary with respect to said mandrel, (e) a plurality of wedges radially movable with respect to said mandrel and said housing upon axial movement of said sleeve with respect to said housing, and (f) radially movable seal means mounted with said housing.

14. An assembly as recited in claim 13 further comprising a generally tubular valve housing attached to said mandrel at one end thereof and a check valve member biased into engagement with said valve housing, whereby said assembly may function as a down-hole plug.

15. An assembly as recited in claim 14 wherein said check valve member comprises a generally dart-shaped member.

16. An assembly as recited in claim 15 wherein said dart-shaped member has an axial bore therein and further comprising a pilot spring-biased check valve contained within said dart-shaped member bore.

17. A method of locking a down-hole member in place, comprising the steps of (a) lowering the down-hole member into a tubing hanger or the like with a running tool, to a desired down-hole position, (b) activating a structure for holding said down-hole member in place in the tubing hanger or the like at said desired position by actuation of said running tool in a first mode, (c) locking said structure for holding said down-hole member in place in the well casing in its holding position by actuation of said running tool in a second mode different from said first mode, (d) effecting removal of a running tool from the tubing hanger or the like only after the locking of the holding structure for the down-hole member is effected, (e) removing said down-hole member from position within the tubing hanger or the like by actuation of a tool in a third mode different from said first and second modes to simultaneously release locking of said holding structure in said holding position and release holding of said holding structure in said holding position, and (f) subsequently removing said down-hole member with said running tool.

18. A down-hole assembly comprising (a) a generally tubular mandrel, having a linear axis, (b) a sleeve surrounding said mandrel and concentric therewith, and spline-connected to said mandrel, (c) a locking nut concentric with said sleeve and said mandrel and in operative engagement with said sleeve, (d) a generally tubular housing concentric with and surrounding said sleeve, (e) a plurality of wedges radially movable with respect to said mandrel and said housing upon axial movement of said sleeve with respect thereto, (f) radially movable seal means mounted with said housing, (g) a locator associated with and extending slightly radially from said housing, and (h) biasing means for axially biasing said locator.

19. An assembly as recited in claim 18 wherein said locator comprises a locating ring surrounding said housing, and wherein said biasing means comprises spring means.

20. A down-hole assembly comprising (a) a generally tubular mandrel, having a linear axis, (b) a sleeve surrounding said mandrel and concentric therewith, and spline-connected to said mandrel, (c) a locking nut concentric with said sleeve and said mandrel and in operative engagement with said sleeve, said locking nut being in threaded engagement with said sleeve so that rotative movement of said locking nut results in axial movement of said locking nut relative to said sleeve, (d) a generally tubular housing concentric with and surrounding said sleeve, (e) a plurality of wedges radially movable with respect to said mandrel and said housing upon axial movement of said sleeve with respect thereto, (f) a retaining nut releasably attached to said mandrel at one end thereof and abutting said locking nut, so that removal of said retaining nut from said mandrel effects radial movement of said wedges without rotative movement of said locking nut, and (g) radially movable seal means mounted with said housing.

21. A down-hole assembly comprising:

(a) a generally cylindrical cage portion having a linear axis and adapted to be lowered into and then stationarily disposed within a tubing hanger or the like, (b) means for holding said cage portion in place within a tubing hanger or the like, said means including holding members that are radially movable with respect to said cage portion to protrude past the radial extent of said cage portion and engage a tubing hanger or the like, (c) linearly axially movable means for camming said holding members so that they move radially from a first position wherein they do not protrude past the radial extent of said cage portion to a second position wherein they do protrude past the radial extent of said cage portion and engage a tubing hanger or the like, (d) means for providing a seal isolating the annulus between said cage portion and a tubing hanger or the like from well pressure, said seal provided generally coincident with radial movement of said holding members into said second position, (e) means for locking said camming means in place so that said holding members are retained in said second position until release of said locking means, (f) means operatively associated with said camming and locking means for receiving actuating means for actuation of said camming and locking means, and (g) means for facilitating holding of said assembly in proper position with a tubing hanger or the like upon linear axial movement of said camming means to radially move said holding means, said facilitating means comprising a locating ring.

22. An assembly as recited in claim 21 further comprising means for minimizing the friction between the tubing hanger or the like, holding means, camming means, and cage means upon linear axial movement of said camming means, said friction minimizing means comprising spring means acting between said cage means and said locating ring.

23. a tubing plug comprising:

(a) a generally cylindrical cage portion having a linear axis and adapted to be lowered into and then stationarily disposed within a tubing hanger or the like, (b) means for holding said cage portion in place within a tubing hanger or the like, said means including holding members that are radially movable with respect to said cage portion to protrude past the radial extent of said cage portion and engage a tubing hanger or the like, (c) generally cylindrical means for camming said holding members so that they move radially from a first position wherein they do not protrude past the radial extent of said cage portion to a second position wherein they do protrude past the radial extent of said cage portion and engage a tubing hanger or the like, said means being concentric with said cage means, and radially inwardly thereof, (d) means for providing a seal isolating the annulus between said cage portion and a tubing hanger or the like from well pressure, said seal provided generally coincident with radial movement of said holding members into said second position, (e) generally cylindrical means for locking said camming means in place so that said holding members are retained in said second position until release of said locking means, said means being concentric with said cage means, and radially inwardly thereof, (f) means operatively associated with said camming and locking means for receiving actuating means for actuation of said camming and locking means, (g) a generally tubular mandrel disposed concentric with said camming and locking means and radially inwardly thereof, (h) a tubular valve housing attached to said mandrel at one end thereof, and a check valve disposed within said valve housing and biased into sealing engagement therewith, and (i) a retaining nut releasably affixed to the end of said mandrel opposite said valve housing, said retaining nut abutting said locking member and limiting axial movement thereof, and said retaining nut comprising means for effecting movement of said holding means to said first position without release of said locking means.

24. A down-hole assembly comprising:

(a) a generally cylindrical cage portion having a linear axis and adapted to be lowered into and then stationarily disposed within a tubing hanger or the like, (b) means for holding said cage portion in place within a tubing hanger or the like, said means including holding members that are radially movable with respect to said cage portion to protrude past the radial extent of said cage portion and engage a tubing hanger or the like, (c) linearly axially movable means for camming said holding members so that they move radially from a first position wherein they do not protrude past the radial extent of said cage portion to a second position wherein they do protrude past the radial extent of said cage portion and engage a tubing hanger or the like, (d) means for providing a seal isolating the annulus between said cage portion and a tubing hanger or the like from well pressure, said seal provided generally coincident with radial movement of said holding members into said second position, and comprising means responsive to linear axial movement of said camming means to radially expand into engagement with the tubing hanger or the like, (e) a locking member, rotatable with respect to said camming means and in threaded engagement therewith, for locking said camming means in place so that said holding members are retained in said second position until release of said locking means, and (f) means operatively associated with said camming and locking means for receiving actuating means for actuation of said camming and locking means, said means comprising surface means formed on said locking member for receipt of a running tool for effecting relative rotational movement between said camming means and said locking member so that detachment of a running tool from said locking member is only possible when said locking member is in positive locking engagement with said camming means.

25. An assembly as recited in claim 24 wherein said surface means comprise at least one J-shaped slot formed in an exterior surface of said locking member.

26. A down-hole assembly comprising:

(a) a generally cylindrical cage portion having a linear axis and adapted to be lowered into and then stationarily disposed within a tubing hanger or the like, (b) means for holding said cage portion in place within a tubing hanger or the like, said means including holding members that are radially movable with respect to said cage portion to protrude past the radial extent of said cage portion and engage a tubing hanger or the like, (c) means for camming said holding members so that they move radially from a first position wherein they do not protrude past the radial extent of said cage portion to a second position wherein they do protrude past the radial extent of said cage portion and engage a tubing hanger or the like, (d) means for providing a seal isolating the annulus between said cage portion and a tubing hanger or the like from well pressure, said seal provided generally coincident with radial movement of said holding members into said second position, (e) means for locking said camming means in place so that said holding members are retained in said second position until release of said locking means, (f) means operatively associated with said camming and locking means for receiving actuating means for actuation of said camming and locking means, (g) a generally tubular mandrel concentric with said cage means, and (h) means for effecting movement of said holding means to said first position without release of said locking means, said effecting means comprising a retaining nut releasably affixed to an end of said mandrel, and abutting said locking member and limiting the axial movement thereof.

* * * * *